US011378075B2

(12) United States Patent
Rampolla

(10) Patent No.: US 11,378,075 B2
(45) Date of Patent: Jul. 5, 2022

(54) PERISTALTIC PUMP AND METHOD FOR THE REALIZATION OF A PERISTALTIC PUMP

(71) Applicant: IN10SIVECARE S.R.L., Salerno (IT)

(72) Inventor: Arturo Rampolla, Palermo (IT)

(73) Assignee: IN10SIVECARE S.R.L., Salerno (IT)

( * ) Notice: Subject to any disclaimer, the term of this patent is extended or adjusted under 35 U.S.C. 154(b) by 43 days.

(21) Appl. No.: 16/477,902

(22) PCT Filed: Feb. 7, 2018

(86) PCT No.: PCT/IB2018/000085
§ 371 (c)(1),
(2) Date: Jul. 15, 2019

(87) PCT Pub. No.: WO2018/146541
PCT Pub. Date: Aug. 16, 2018

(65) Prior Publication Data

US 2019/0345932 A1 Nov. 14, 2019

(30) Foreign Application Priority Data

Feb. 7, 2017 (IT) ..... 102017000013374

(51) Int. Cl.
*F04B 43/12* (2006.01)
*F04B 53/22* (2006.01)
*F04B 53/16* (2006.01)

(52) U.S. Cl.
CPC ..... *F04B 53/16* (2013.01); *F04B 43/1238* (2013.01); *F04B 53/22* (2013.01)

(58) Field of Classification Search
CPC ..... F04B 53/16; F04B 53/22; F04B 43/1238
See application file for complete search history.

(56) References Cited

U.S. PATENT DOCUMENTS 3,358,609 A * 12/1967 Worth ..... F04B 43/1253 417/477.6
8,567,235 B2 * 10/2013 Bojan ..... A61M 5/14212 73/37
2014/0271273 A1 * 9/2014 Carpenter ..... F04B 43/1261 417/412

* cited by examiner

*Primary Examiner* — Patrick Hamo
(74) *Attorney, Agent, or Firm* — Mark M. Friedman

(57) ABSTRACT

A peristaltic pump (1) of the type comprising a stator which supports a portion of tube or sub-pump tube intended for the passage of a fluid to be pumped and a pressor element adapted to exert a pressure on said sub-base to determine a cyclical narrowing of the latter for the movement of the fluid inside it; the pump (1) comprises: —a support base (2) provided with first locking means (22) for a body defining the stator; —a stator (3), constituted by a hollow body provided with an internal groove (37) which extends for at least 360° and which accommodates said sub-pump tube (7), keeping it exposed towards the inside of the same stator, and provided with seconds locking means (30) complementarily shaped with respect to said first locking means (22) to allow locking of said stator (3) on said base (2); —a single pressor element (4) provided with motorization means for rotation about its own axis, so as to make it move along a circular trajectory when it is in contact with said sub-pump tube (7); and in that the value of the compression of the tube (7) is different along the trajectory followed by said pressor (4) so as to determine the gradual compression, the gradual distension and the total occlusion and allow the peristaltic action on the tube (7) same.

14 Claims, 5 Drawing Sheets

PERISTALTIC PUMP AND METHOD FOR THE REALIZATION OF A PERISTALTIC PUMP

The present invention relates to a peristaltic pump and a method for its realization. As will be better described hereinafter, the peristaltic pump of the present invention is coupled to a removable (and potentially disposable) support which holds the sub-pump tube and any additional components both for the control and for the eventual treatment of the pumped liquid.

The invention is inserted in the medical field and, in particular, in the treatment of blood in extracorporeal circulation, an area in which the following aspects are of major importance: the reduction of trauma, the possibility of rapid circuit replacement, the assurance of asepsis, the reduction of risk related to possible human errors and the simplicity and safety of execution.

This will not prevent extending the use also to other areas, as critical as the treatment of food substances, the pharmaceutical industry, chemistry, etc.

As stated previously, the common peristaltic pumps are composed of an external cylindrical stator and an internal rotor coaxial to the stator. The rotor comprises two or more pads or rollers and is moved by means of a motor connected to it. The motor rotates the internal rotor which drives the rollers (or pads) into its circular motion. A portion of tube or "sub-pump tube" (in this way the segment of elastic tube subjected to the peristaltic action of the pump is in fact called in technical jargon) is placed manually between the space between the inner surface of the stator, which acts as a plane of reaction, and the circumference described by the pressure elements (shoes or rollers) which rotate integral with the rotor, arranged along the external surface of the latter.

In peristaltic pumps of a known type, the space for receiving the sub-pump tube is designed to be equal to the sum of the thickness of the walls of the tube to be compressed (small variations in plus or minus are chosen according to the type of pipe or of the fluid to be pumped). The rollers compress the tube progressively occluding it against the stator in their rotary motion. The compressed tube generates the flow by variation of its internal volume. In the tube section arranged upstream of the compression performed by the rotor (that is on the portion already affected by compression of the pressure rollers), the tube resumes its original shape thanks to its elastic memory, sucking the fluid to be pumped. The cyclic and mono-directional repetition of this action allows pumping.

Peristaltic pumps of the known type are not always able to provide high quality standards with regard to the aspects mentioned above, i.e. with regard to the reduction of traumatism, the possibility of rapid circuit replacement, the guarantee of asepsis, the reduction of the risk related to the possible human errors, as well as the simplicity and safety of execution.

Among the aims of the present invention there is therefore that of providing very high standards for the aforementioned aspects, thanks to the structural and functional characteristics listed below and relating to a preferable embodiment:

- the pump comprises a single pressor which is cantilever mounted on a rotating base which rotates around an axis parallel but eccentric with respect to the pressor axis;
- the pressor is motorized for rotation around its longitudinal axis;

- the pump is provided with a single pressure roller so as to increase the efficiency of the pump, reduce tube wear and trauma to the blood; moreover, the presence of a single pressor allows an extremely simple coupling of the pump/kit (i.e. pump/stator provided with a sub-pump tube), impossible to be found in the other cases of the known art;
- the rotating base is idle pivoted, free to rotate around its own axis, which is parallel and different from that of the pressor;
- the stator consists of a hollow cylinder of rigid material (preferably transparent);
- the stator is firmly fixed to the pump base thanks to self-centering joints, that is to say, able to allow correct positioning and alignment between the stator and the base;
- the stator is firmly fixed on the pump base in such a way that the axis of its internal cylindrical cavity coincides with the rotation axis of the idle rotating base;
- the diameter of the internal cylindrical cavity of the stator is dimensioned so as to contain inside it the orbit that the pressor describes by rotating with the movable base, in addition to the thickness of the walls of the sub-pump tube;
- the stator supports at least one whole coil of the sub-pump tube, stator being preferably provided with an internal groove of substantially helical shape, with at least two diameter variations to allow the gradual compression and distension of the diameter of the under-pipe; in practice, the stator is provided with a groove formed by a helix that extends along the inner cylindrical surface of the same stator, presenting a variable diameter along the height of the stator so as to define three differentiated portions which are invested in succession and cyclically from the pressor in its circular path;
- the stator constitutes the reaction plane on which the pressor presses the sub-pump tube along its orbit around the axis of the rotating base.

The advantages and characteristics of the invention will be more evident from the following description which refers to the attached drawings, provided as a non-limiting example, in which.

Figure 1:
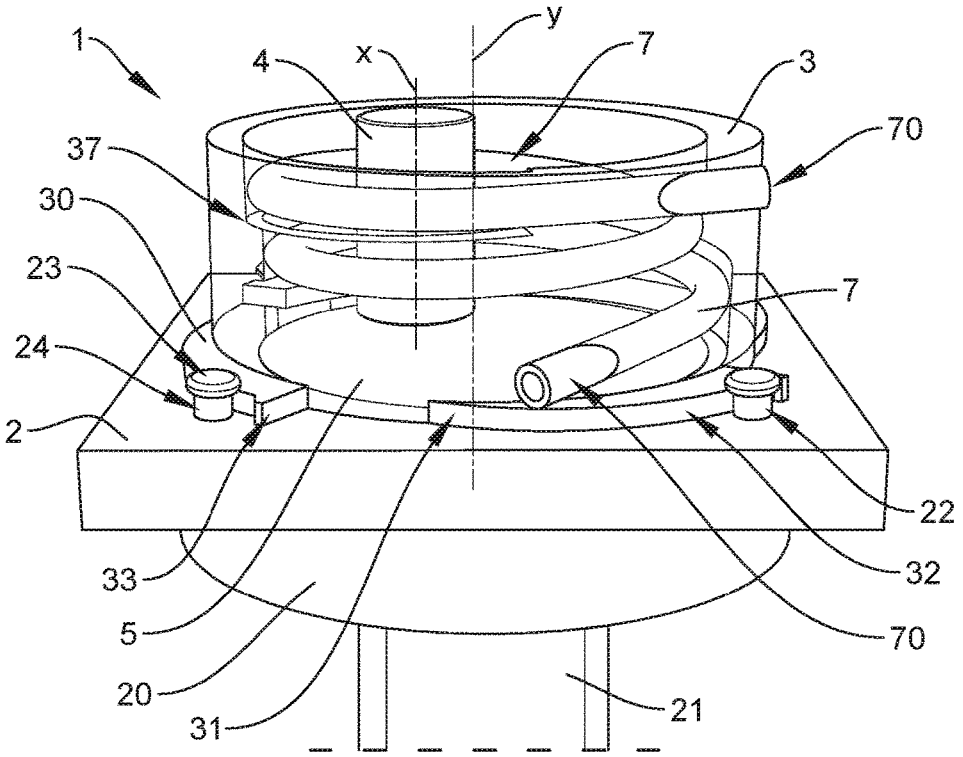
FIG. 1 is a schematic perspective view of a possible embodiment of the invention.
Figure 2:
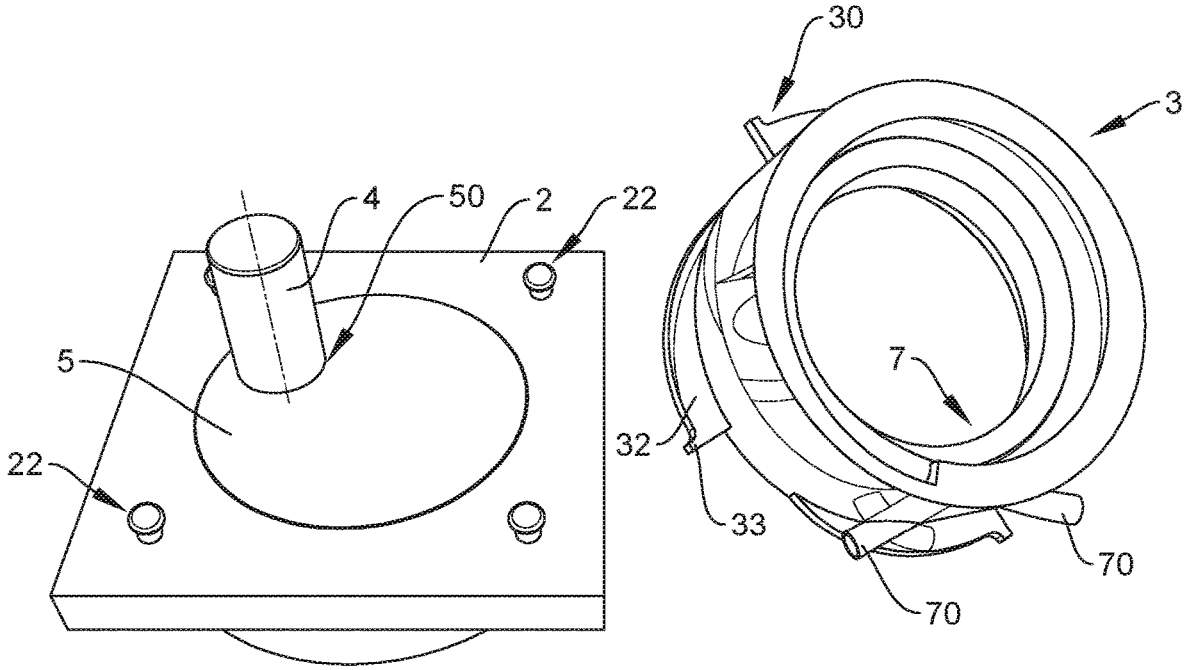
FIG. 2 is a schematic exploded perspective view of the example of FIG. 1.
Figure 3:
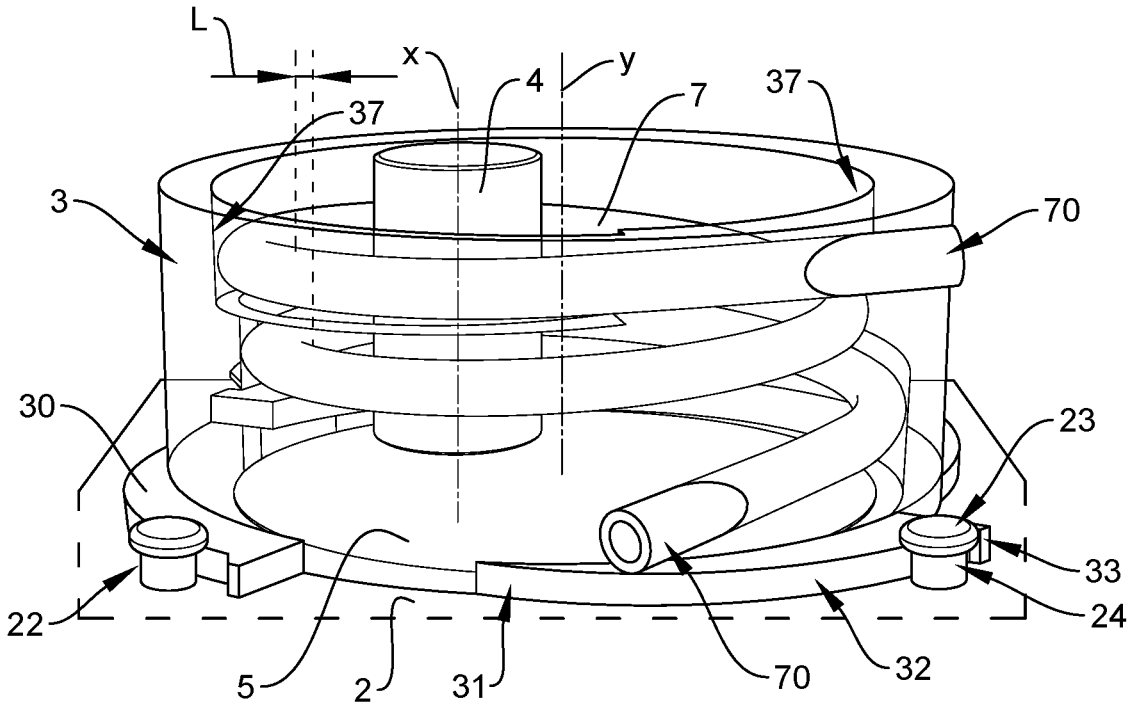
FIG. 3 is a schematic enlarged perspective view of a detail of FIG. 1.

With reference to the drawings of the attached figures, a peristaltic pump (1) according to the present invention is substantially constituted by a base (2) on which a stator (3) and a pressor (4) are arranged.

The base (2) comprises an electric motor (21), located below it, and a support and containment structure (20) inside which the means for transmitting the motion and movement of the pressor (4) can be contained.

The stator (3) consists of a hollow cylindrical body provided inside a groove (37) with a helical lay adapted to receive the sub-pump tube (7). In the preferred (but not limiting) solution shown in the drawings, the assembly formed by tube (7)/stator (3) is designed as a pre-assembled single-use kit to increase ease of assembly and operational safety. According to other embodiments, not illustrated, it is possible to provide a reusable stator in which it is possible to manually preload the sub-pump tube, for less critical uses and for purposes of greater economy of operation.

In the illustrated example the ends of the sub-pump tube (7), usable for upstream and downstream connection, are marked with (70); moreover, it is possible to notice that inside the stator (3) the sub-pump tube (7) follows a helical path with a variable diameter. More particularly, the sub-pump tube (7) presents, from upstream to downstream, an initial portion which is more distant from the center of the cylindrical body of the stator (i.e. from the axis marked with y in the drawings), an intermediate portion which is more close to said axis (y) and an end portion which is again spaced from the axis (y). In the drawings the difference between the distances from the center of these portions is indicated with (L). This particular arrangement allows the pressor to interact with the sub-pump tube in an extremely effective manner, as better expressed later.

In the examples of the drawings it is provided that the groove (37) of the stator (3) is formed by a helix that extends along the inner cylindrical surface of the stator, presenting a variable diameter along the height of the stator so as to define said initial, median and terminal portions that are invested in succession and cyclically by the pressor (4) in its circular path. In particular, the groove (37) does not have a constant diameter and is provided with a series of steps indicated with (370) in FIG. 5.

The stator (3) is provided, in its lower portion, with a plurality of arcuate wings (30) with variable development increasing in one direction (e.g., levorotatory like in the drawings). In practice, the appendices (30), which are four in the illustrated example, are developed on a plane perpendicular to the axis (y) of the body of the stator (3), i.e. on a plane which is parallel to that of the upper surface the base (2) when the stator (3) is fixed to the base (2) in the configuration of use. Each of the appendices (30) protrudes progressively from the body of the stator (3), from an initial point (31), which substantially coincides with the external surface of the stator, up to an end portion (32) which, further protruding in a radial direction with an arched beveled portion forms a sort of tooth (33); the appendices (30) are therefore cam elements which interact with corresponding pins (22) presented by the base (2). The pins (22) have a stem (24) protruding from the upper surface of the base (2) for a value corresponding to the thickness of the cam elements (30) and a head (23) with a larger diameter which defines a vertical block for the tooth (33) of the same cam elements (30). This feature makes it possible to associate the assembly formed by stator (3)/sub-pump tube (7) to the base (2) with a simple and safe operation, i.e. with an operation that determines a fast association and with very few risks of incorrect positioning. In other words, it is sufficient to fit the assembly stator/sub-pump tube on the pressor and "screw" the stator (3) on the base (2). In this way, the sub-pump tube (7) which is permanently inserted into the groove (37) of the stator (3), is positioned in the correct configuration for the interaction with the pressor (4), thus excluding in substantially absolute manner the possibility of twisting and/or unwanted squeezing of the same sub-pump tube.

In the peristaltic pump (1) of the invention there is a single pressor roller (4) in order to increase the efficiency of the pump, to reduce tube wear and trauma to the blood.

Furthermore, the presence of a single pressor allows an extremely simple coupling of the pump/kit (i.e. pump/stator provided with a sub-pump tube), impossible to be found in the other cases of the known art.

In the illustrated example, the pressor (4) is motorized so as to rotate around its longitudinal axis (x). The pressor (4) is arranged cantilevered with respect to a circular platform (5) which is rotatable with respect to the base (2). In particular, the platform (5) is provided with a circular hole (50) crossed by the cylindrical pressor (4); in use, the pressor (4) rotates about its own axis (x) and inside the hole (50), rotatably idle with respect to the platform (5). The interaction of the pressor (4) with the sub-pump tube (7) determines the rotation of the platform (5) with a circular trajectory of the pressor (4), due to the friction between the sub-pump tube (7), which is integral with the stator (3), and the pressor (4), which rotates in contact with the same sub-pump tube (7) and drives the platform (5) in respect to which it is cantilevered. In other words, the friction of the pressor (4) rotating about its longitudinal axis (x) with respect to the sub-pump tube (7) integral with the stator (3) (and therefore also with the base 2) causes, by reaction, the moving of the pressor (4) along an orbit described inside the stator (and coinciding with the orbit formed by the coil of the sub-pump tube pressed against the cavity of the stator). This movement determines the subsequent complete compression of the tube (7) for the whole length of the coil thus generating the pumping action.

Figure 5:
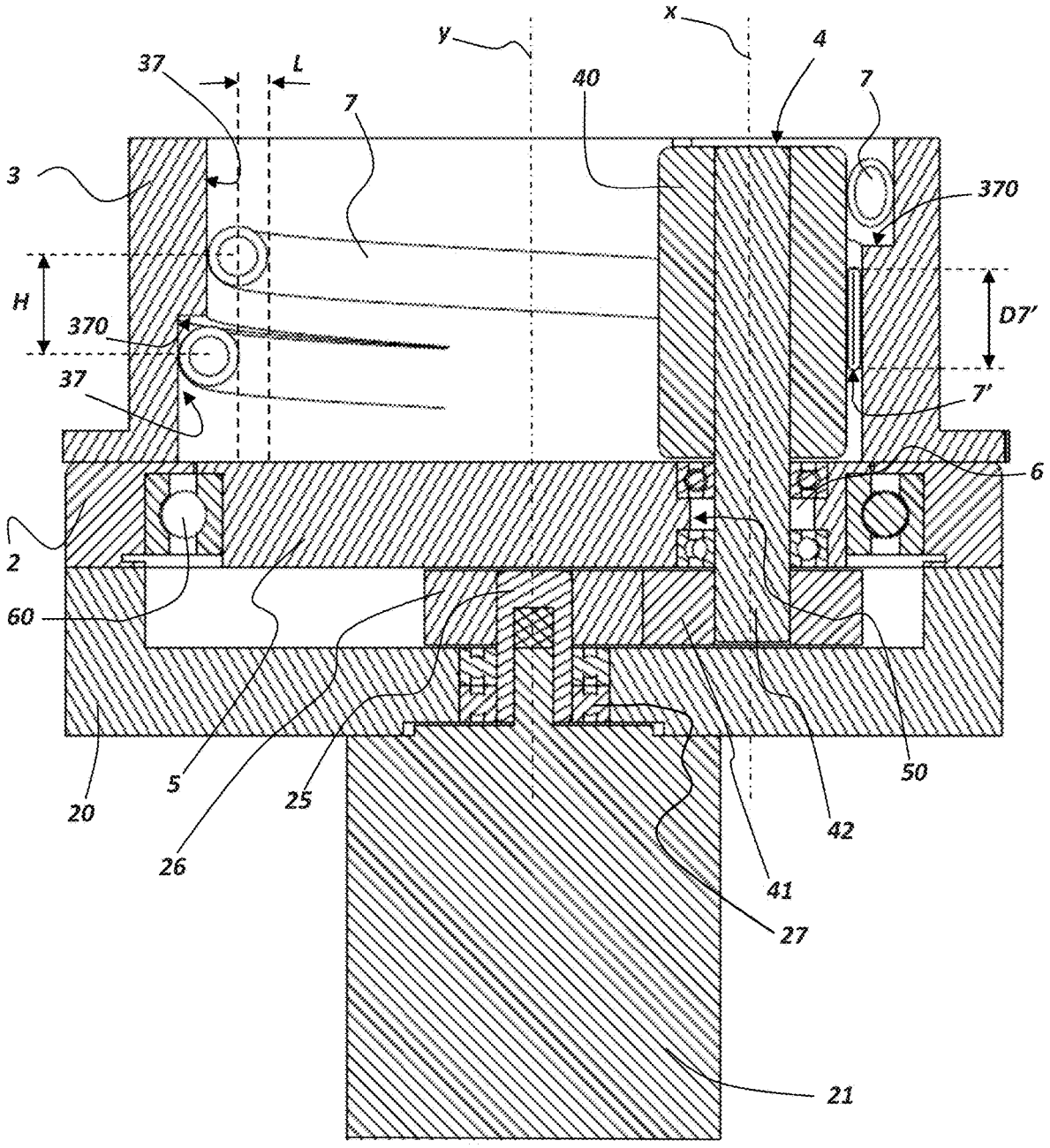
FIG. 5 is a sectional view of the example of FIG. 1.

More particularly, with reference to FIG. 5 which shows in detail the preferred embodiment of the invention of the previous figures, the motor (21) drives a relative drive shaft (25) on which a pinion (26) is keyed which, in turn, is meshed with a toothed wheel (41). The motor (21) is fixed to the containment body (20), with respect to which the drive shaft (25) is made independent in the rotation by a bearing (27) which is arranged between said shaft (25) and the containment body (20). The toothed wheel (41) is keyed onto a shaft (42) on which a cylindrical casing body (40) is fitted defining the outer surface of the pressor (4). The rotating platform (5) is rotatably idle with respect to the base (2) thanks to the ball bearing (60) arranged and acting between the platform (5) and the base (2); similarly, the shaft (42) of the pressor (4) is rotatably idle with respect to the rotating platform (5) thanks to the ball bearing (6) arranged and acting in the hole (50), between the platform (5) and the same shaft (42).

In the operation of the pump (1), the motor (21), by means of the shaft (25) and the gear train formed by the pinion (26) and by the toothed wheel (41), rotates the pressor (4) around its longitudinal axis (x). The rotation of the pressor (4) which is in contact with the sub-pump tube (7) supported by the stator (3) causes a sort of "rolling" of the same pressor along the sub-pump tube (7), determining the succession of compressions of the same sub-pump tube and, therefore, the pumping effect of the pump (1).

The solution shown in the drawings has a helical arrangement of the sub-pump tube (7) since the same must necessarily make a complete revolution (360°) or almost, as will be seen below, so that, at each point of the cyclic rotation of the pressor roller there is a section of tube occluded by the roller itself.

In the embodiment of the present invention, further circumference arches of the sub-pump tube are dedicated to allow a gradual achievement of full occlusion and full re-opening of the tube (7) by the pressor (4), which, in its path inside the stator (3), always compresses at least two coils of the sub-pump tube, one of them always occluded while the other alternately in occlusion or opening.

Figure 4:
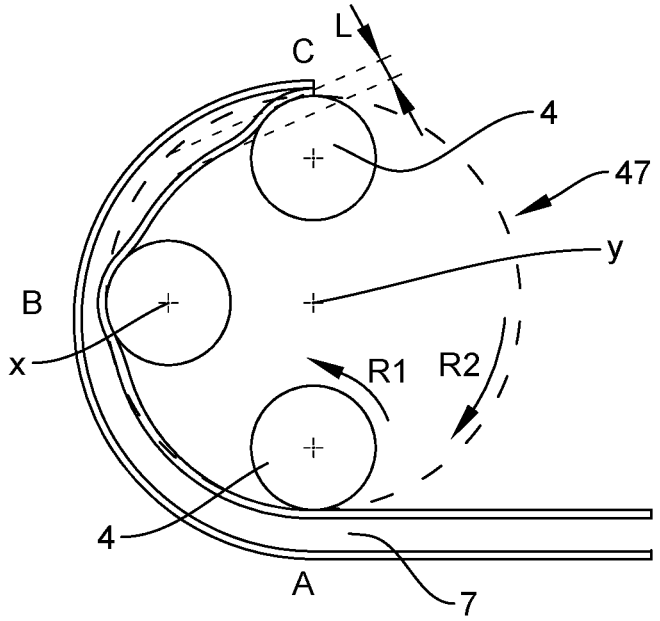
FIG. 4 is a diagram relating to the mode of action of the pressor on the sub-pump tube.

With reference to the diagram of FIG. 4, the pressure element or pressor roller (4) is therefore provided with motor means adapted to allow its rotation (R1) around its vertical axis, indicated by (x). The pressure roller (4) is supported by the idle rotating base (5), which rotates inside the stator (3) (see rotation indicated with R2) allowing the cyclic interaction between the sub-pump tube (7) supported by the same stator (3) and the pressure roller (4). The external trajectory of the circular path of the pressor (4) is indicated by the numerical reference (47). The circumference (47) is therefore the line along which the interference (i.e. the pumping action) is implemented between the pressor (4) and the sub-pump tube (7).

The sub-pump tube (7) (made of elastic material with shape memory, e.g. PVC or silicone) is mounted on the removable stator (3), inserted in the housing (37), wound inside the wall of the same stator whose section in this first section is an arc of circumference, eccentric with respect to the orbit described by the pressor (4) in its circular movement, and with a helical shape that employs substantially 180° (in the illustrated but not limiting form) to increase of a suitable value to bring the tube from a position where it is only touched by the circular path (see position A of FIG. 4) of the pressure roller until it is subjected, with a slow and progressive pressure (see position B of FIG. 4), to the complete compression (see position C of FIG. 4). The sub-pump tube (7) remains at this distance (completely compressed by the roller), wound around the stator with a constant circular cross-section and concentric to the circular orbit of the pressor, but still maintaining a helical pattern, for an entire rotation (360°) or almost, as will be explained later. At the end of the turn, in the following 180° the groove (37) of the stator (3) has a spiral section or an eccentric circular section (with a helical shape) while the distance from the pressure roller decreases gradually until the sub-pump tube is completely expanded and returns to the original diameter. The pitch of the helix will remain constant throughout the development of the sub-pump tube path within the stator.

In the example illustrated in the accompanying drawings, the stator (3) is a substantially cylindrical body which is hollow inside to allow insertion of the sub-pump tube (7) around the pressor path (4).

Internally, from top to bottom, the stator (4) has a first portion which develops in an eccentric circular section with decreasing diameter until a minimum value is reached which is kept concentric by 360° (variations less than that arc amplitude will be decided according to the type of tube or to the fluid to be pumped, also keeping in mind the intent to avoid trauma due to blood shear stress that could compromise the integrity of the solid components of the blood itself as well as avoiding excessive and sudden mechanical stress to the tube; in this embodiment a path of complete occlusion around 300 degrees is assumed) assuming a cylindrical circular shape, and a last portion (180° in the example) where an eccentric circular path again but this time increasing returns to the maximum starting diameter. The path of the under-pipe defines a helix along the axis of the stator to avoid overlapping the tube. The advantages deriving from this arrangement are, in the object of the present invention, the following:

a) Compared to a traditional peristaltic pump, with the same diameter of the pressor roller and the same circumference formed by the tube, the presence of a single pressor reduces at least half (compared to the common solution with two pressors) the compressions suffered by the tube (and by the blood); this results in a reduction in tube wear and hemolysis. Furthermore, the volume subtracted by the compression of the rotor in the tube is smaller. A greater efficiency of the pumped volume per revolution is obtained.

b) The compression of the tube is very gradual compared to traditional pumps thanks to a slow exposure of the under-pump tube to the pressing action of the pressor. The stress on the tube caused by the compression/decompression of the same tube against the stator is distributed along an arc of 180°+180° (in the illustrated solution). In traditional pumps this variation, from full diameter to complete occlusion and vice versa, occurs in a limited range (5°-10°). The illustrated solution, as well as further increasing the life of the tube, also allows to reduce the pressure peaks due to the sudden compression and decompression of the tube. Thus are also reduced the pulsations on the tube due to the sudden variations in flow and pressure and the back flow.

c) In the present invention a single rotor is used which offers advantages of greater pumping efficiency and less tube wear (which is compressed only once per revolution of the pressor).

d) To obtain the solution described in the previous point it is necessary that the path of the sub-pump tube is not coplanar but that it develops along a cylindrical helix with a length greater than one turn (two turns in the example described). This need could complicate manual assembly of the sub-pump tube. To overcome this difficulty, and to obtain further advantages, the possibility of making the stator itself removable from the pump seat, even making it disposable, has been provided, in which case the under-pump tube is pre-assembled at the factory on the stator.

e) The removable stator and the presence of a single pressor greatly simplify the tube assembly operations because the already pre-assembled assembly (preferably disposable) consisting of coupling tube/stator will be inserted on the pump. There are safety advantages due to reduced handling requirements and consequent reduction of operational errors.

f) The tube/stator assembly will be integrated with suitable hydraulic connections to connect to the rest of the circuit.

g) In the disposable version, the kit composed of the tube/stator assembly can integrate sensors of various types, components for the chosen extracorporeal treatment (oxygenators, hemofilters, etc.).

h) The motorization of the pressor which allows to optimize the interaction of the same pressor with the sub-pump tube; in fact, the fact that it is the pressor to drag itself along the tube causes the tube to be "pushed" upstream, (and possibly "pulled" and "thinned" downstream), improving the tendency of the tube to recover its own original section. In this way, it is avoided the phenomenon which could happen if the pressor was rotated along the tube without having its own motorization around its own axis; this phenomenon would cause the "stretching" that would be caused by the dragging of the pressor that would tend in that case, to have the opposite effect, i.e. to "thin" the diameter of the tube upstream rather than downstream. In other words, with a "thinning" downstream, there is no reduction in pumping efficiency, while with a "thinning" upstream the pipe is filled less.

Figure 6:
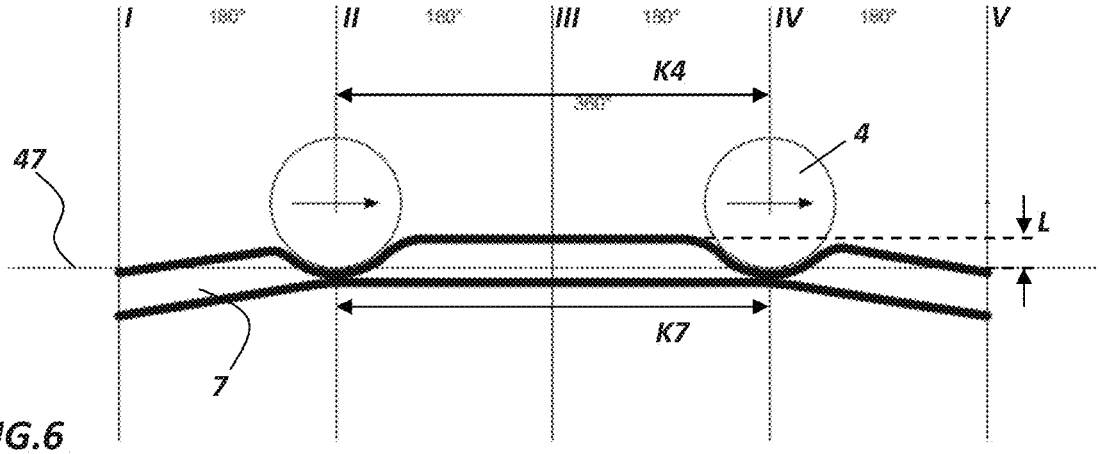
FIGS. 6, 7 and 8 represent further diagrams relating to the action of the pressure on the sub-pump tube.
Figure 7:
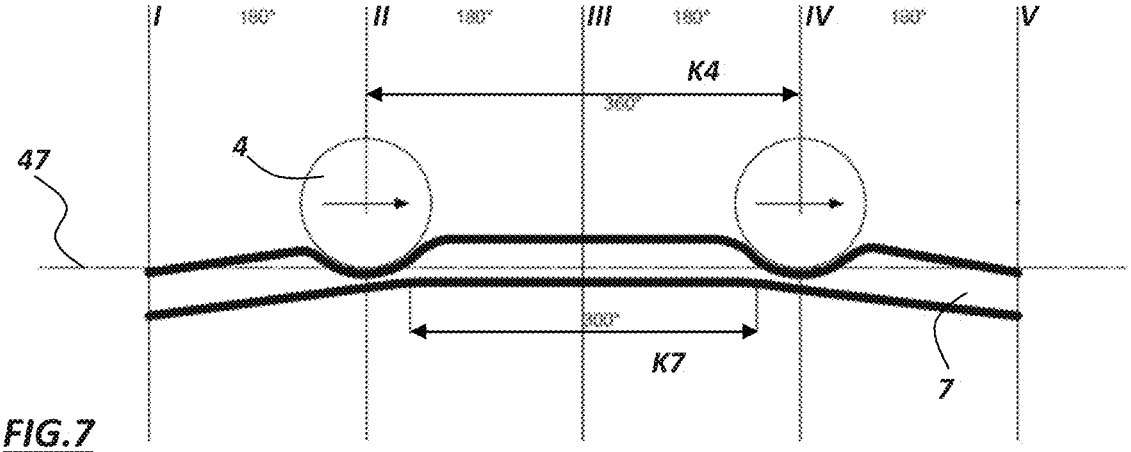

In FIGS. 5, 6, 7 the sub-pump tube (7) is schematically represented "unwound" or arranged in a substantially "linear" configuration which is not the real one, substantially helical, assumed when it is contained in the groove (37). Similarly, the circular path (47) followed by the pressor (4) is represented by a straight line (47) which is horizontal in the figures, while the pressor (4) is shown twice because every 360° there is an interaction between the pressor (4) and sub-pump tube (7); in practice, the two representations of the pressor, which in the drawings are spaced by a value (K4) corresponding to 360°, are representative of the two points in which the pressor invests the coils of the sub-pump tube (7) after a complete revolution. Moreover, in the diagram of these figures, the vertical lines (I), (II), (III), (IV), (V) indicate the sequence from upstream to downstream of the interactions between the pressor (4) and the sub-pump tube (7), each of these interactions being angularly spaced 180° from the previous one.

Figure 8:
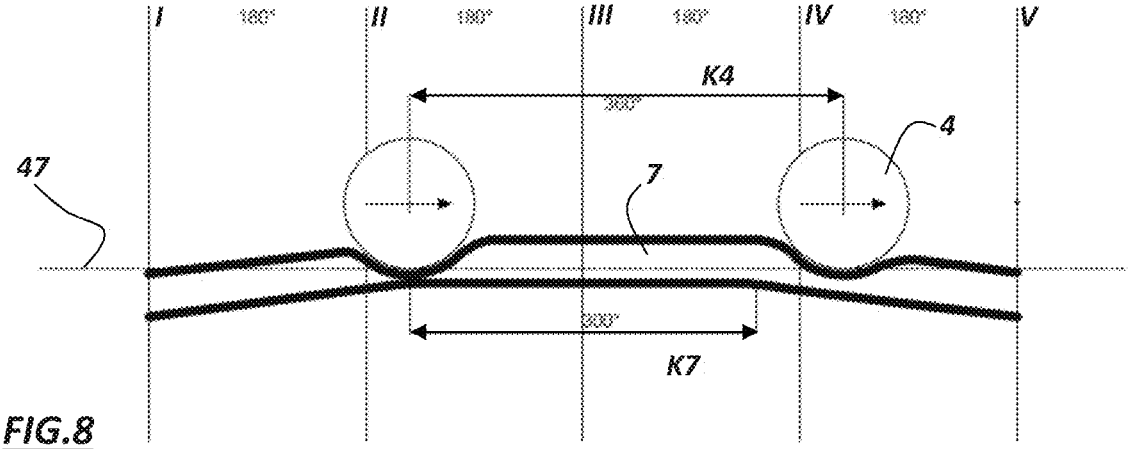

FIGS. 5, 6, 7 are explanatory as regards the importance of the precise positioning of the sub-pump tube (7) with respect to the action of the pressor (4), which in the reference of the drawings in FIGS. 6, 7, 8 moves hypothetically to the right.

For example, FIG. 6 shows an example which is not preferably chosen for the implementation of the present invention. In particular, the areas of the sub-pump tube (7) which protrude more towards the inside of the stator (3), i.e. those which are completely occluded by the pressor (4) are spaced apart by a value (K7) which in FIG. 6 corresponds to 360°. This arrangement determines the simultaneous complete occlusion of the tube (7) both downstream and upstream, double occlusion which could be harmful for the fluid to be pumped when this is blood.

The arrangement of the sub-pump tube (7) shown in FIGS. 7 and 8 is advantageous. In the example shown in these figures, the portion of sub-pump tube (7) comprised between the two zones which protrude more towards the inside has a value (K7) lower than 360°, which in the illustrated non-limiting example is equal to about 300°. This particular and advantageous feature determines an optimal pumping action.

In the configuration of FIG. 7 the pressor (4), which in the position (I) does not interact at all with the sub-pump tube (7), in the position (II) starts and almost completes the compression of the sub-pump tube (7) having traveled in the distance between (I) and (II) that sort of ascending ramp that increases the value of the exerted pressure, and therefore the reduction of the space inside the tube until complete occlusion, along the path of the pressor (4) in its circular trajectory represented by the straight line (47) in the figure. The pressor (4) which compresses the tube (7) in position (II), without completely obstructing it, compresses simultaneously the section further downstream of the tube (7) in position (IV) for a value substantially similar to that of position (II).

Subsequently, as shown in FIG. 8, the pressor (4) moves downstream completely closing the tube (7) and, thanks to the distance (K7) less than 360° (of about 300° in the drawing) between the two portions of tube (7), the pressor (4) interacts with the other portion further downstream of the tube (7) without completely obstructing it. This positioning of the sub-pump tube (7) in the groove (37) of the stator (3) allows to optimize the flow rate of the pump and also allows to produce a peristaltic pump for the movement of blood capable of not damaging the pumped fluid. The choice of the aforementioned interval proved to be particularly advantageous even after the experiments carried out.

Figure 9:
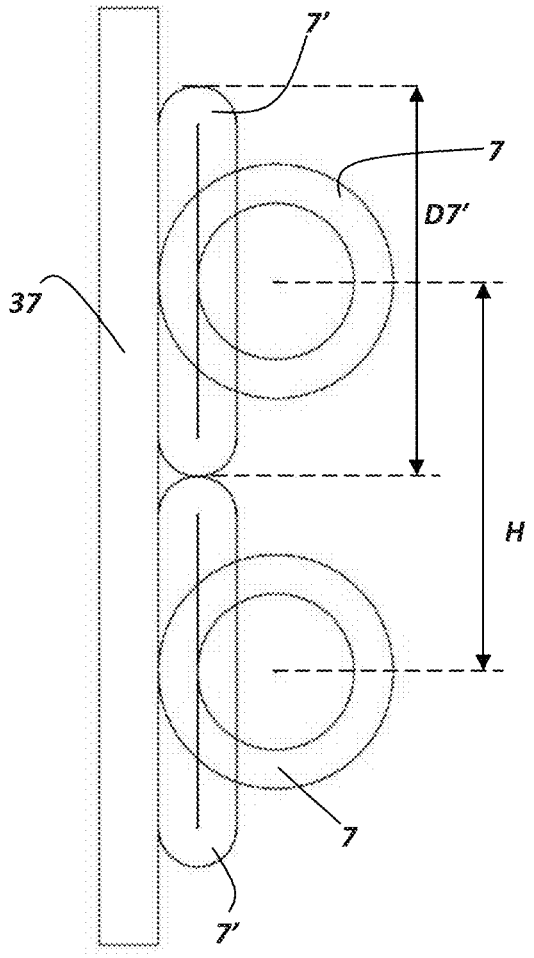
FIG. 9 is a diagram relative to the positioning of the sub-pipe inside the stator.

The diagram of FIG. 9 highlights another feature of the present invention relating, in particular, to the arrangement of the sub-pump tube in its succession of coils inside the stator (3). In FIG. 9 the groove (37) which houses the sub-pump tube (7) is shown as a constant cross-section to simplify the drawing; in reality it is provided with at least one step as shown in the other drawings. Advantageously, the two successive portions of the sub-pump tube (7) are spaced apart by a value (H) which corresponds to the extension (D7') of the tube when it is squeezed, i.e. is in the configuration indicated by (7'). In fact, in the drawing, for each of the two portions of the sub-pump tube (7) both the "resting" configuration (indicated with 7) and the "squeezed" configuration (indicated with 7) are simultaneously represented.

The present invention also relates to a method of realization a pump which provides to realize a disposable stator i.e. having an sub-pump tube therein inserted during manufacture. Therefore, the industrial realization of the pump (1) according to the invention provides for the manufacture of a pump body comprising the base (2) and the motorizing means of the pressor (4) with respect to the base (2) and a disposable stator (3), in which the sub-pump tube is inserted and which is provided with devices for the treatment of blood such as oxygenators, hemofilters, and/or sensors of various types, etc. . . . In this way, it is obtained a reusable pump body which can be equipped by means of the stator-sub-pump tube assembly, an assembly which is already set up for use and which is easily and above all safety connectable to the pump body.

In conclusion, among the advantages of the present invention the following can be listed.

The preparation of the pump is extremely easy, fast and error-proof because, unlike traditional peristaltic pumps, the stator is removable and pre-assembled at the factory so the pump (1) does not require manual actions for the assembly of the various tubing.

The pressor (4) is a single roller so it is considerably smaller than the space presented inside the stator (3) even if the stator is already pre-assembled with the sub-pump tube (7). It is sufficient to fit the stator around the pressor (4) putting it on the base of the pump and rotating it until it stops in position, thanks to the fixing means consisting of the fixing appendices which automatically center the stator coaxially with the rotating platform (5) and with the pressor orbit (4) without the need for moving parts. The stator (3), which is external to the orbit of the pressor (4), protects the operator from accidental contact with the pressor during its movement.

What is described is intended with reference to what is illustrated in the attached diagrams which constitute embodiments of the invention.

Moreover, the details of execution may in any case vary in the form, size, arrangement of the elements, nature of the materials used, without however departing from the idea of the solution adopted or the inventive concept and therefore remaining within the limits of the protection given by the present patent.

The invention claimed is:

1. Peristaltic pump comprising a stator that supports a sub-pump tube through which a fluid to be pumped passes and a single pressor element apt to exert a pressure on said sub-pump tube to determine a cyclic constriction of the latter for the moving of the fluid therein, pump (1) characterized in that it comprises:

a support base (2) provided with a first locking means (22) for a body defining the stator;

said stator (3), consisting of a hollow body provided with an internal groove (37) which extends for at least 360° and which accommodates said sub-pump tube (7), keeping said sub-pump tube exposed to an inside of said stator, and provided with a second locking means (30) complementarily shaped with respect to said first locking means (22) to allow fixing of said stator (3) on said base (2);

said single pressor element (4) provided with driving means kinematically connected to said single pressor element (4) so that said driving means rotate the single pressor element (4) around its own axis and it along a circular path when it is in contact with said sub-pump tube (7);

and wherein a shape of said groove (37) determines that a degree of a compression of the tube (7) is different along a trajectory followed by said single pressor element (4) so as to cause a gradual compression, then a total occlusion followed by a gradual relaxation of the tube (7) when said single pressor element follows said trajectory, so as to allow a peristaltic action on the tube (7).

2. Pump according to claim 1, characterized in that said locking means are self-centering, able to correctly position the stator (3) with respect to the base (2) following the placement of the stator on the basis and to subsequent rotation of the one relative to the other.

3. Pump according to claim 1, wherein said driving means (21) kinematically connected to said pressor element (4) so as to make it rotate around its axis (x), said pressor element (4) being disposed on a rotatable platform (5) rotatably independent of the base (2) and the stator (3).

4. Pump according to claim 1, characterized in that said pressor element (4) is cylindrical and the groove (37) forms a helix with a constant pitch.

5. Pump according to claim 3, characterized in that said first locking means are a plurality of pins (22) and the second locking means are a corresponding plurality of arcuate lugs (30) with self-centering characteristics of the stator with respect to the orbit (47) described by the pressor element (4) when the idle platform (5) rotates around its own axis (y).

6. Pump according to claim 1, characterized in that the stator (4) supports devices for the treatment of blood and/or sensors for physiological and/or fluid-dynamic parameters.

7. Pump according to claim 1, characterized in that the driving means comprise a motor (21) that drives a relative output shaft (25) on which is keyed a pinion (26), in turn meshed with a toothed wheel (41), said toothed wheel (41) being keyed on a shaft (42) defining the axis (x) of said pressor element (4).

8. Pump according to claim 7, characterized in that the shaft (42) of the pressor element (4) is rotatably idle with respect to a rotating platform (5) which, in turn, is rotatably idle with respect to the base (2).

9. Pump according to claim 7, characterized in that:

said motor (21) is fixed to a containment body (20) forming part of said base (2), the containment body (20) with respect to which the drive shaft (25) is made independent in rotation by means of a first ball bearing (27) arranged between said shaft (25) and the containment body (20);

said toothed wheel (41) is keyed onto a shaft (42) on which a cylindrical coating body (40) is fitted, said body (40) defining the outer surface of said pressor (4);

said pressor (4) being arranged on a platform (5) that is idle rotatable with respect to the base (2) and to the stator (3) by means of a second ball bearing (60) arranged and acting between the platform (5) and the base (2);

said shaft (42) of the pressor (4) is rotatably idle with respect to said rotating platform (5) by a third ball bearing (6) arranged and acting in a perforated portion (50) of said platform, crossed by said pressor (4).

10. Pump according to claim 1, characterized in that the rotation of the pressor (4) which is in contact with the sub-pump tube (7) causes a rolling of the same pressor along the sub-pump tube (7).

11. Pump according to claim 1, characterized in that said groove (37) which houses said sub-pump tube (7) has a variable diameter helical path.

12. Pump according to claim 1, characterized in that successive portions of the sub-pump tube (7) housed in said groove (37) are spaced apart by a value (H) which corresponds to at least the extension (D7') of the tube when it is squeezed.

13. Method for the realization of a peristaltic pump comprising a stator that supports a sub-pump tube through which a fluid to be pumped passes and a pressure element apt to exert a pressure on said sub-pump tube to determine a cyclic constriction of the latter for the moving of the fluid in its inner, method characterized in that it provides for the manufacture of a pump body comprising a base (2), a pressor element (4) and driving means for the pressor element (4) with respect to the base (2), as well as the manufacture of a disposable stator (3), in which the sub-pump tube (7) is inserted and in that the stator (3) is a hollow body provided with an internal groove (37) which extends for at least 360° and which accommodates said sub-pump tube (7), and wherein said shape of said groove (37) determines that a degree of a compression of the tube (7) is different along a trajectory followed by said pressor element (4) so as to cause a gradual compression, then a total occlusion of the tube (7).

14. Method according to claim 13 characterized in that the stator is provided with devices for the treatment of blood and/or sensors for physiological and/or fluid-dynamic parameters.

* * * * *